US010721979B2

(12) United States Patent
White, Jr.

(10) Patent No.: US 10,721,979 B2
(45) Date of Patent: Jul. 28, 2020

(54) MULTIFUNCTION ZIPPER CONFIGURATION FOR JACKET

(71) Applicant: Charles H. White, Jr., Roswell, GA (US)

(72) Inventor: Charles H. White, Jr., Roswell, GA (US)

( * ) Notice: Subject to any disclaimer, the term of this patent is extended or adjusted under 35 U.S.C. 154(b) by 170 days.

(21) Appl. No.: 15/904,043

(22) Filed: Feb. 23, 2018

(65) Prior Publication Data

US 2019/0125012 A1 May 2, 2019

Related U.S. Application Data

(63) Continuation of application No. 15/902,319, filed on Feb. 22, 2018, now abandoned.

(60) Provisional application No. 62/578,186, filed on Oct. 27, 2017.

(51) Int. Cl.

| | |
|---|---|
| ***A41D 15/00*** | (2006.01) |
| ***A41D 27/20*** | (2006.01) |
| *A41D 3/02* | (2006.01) |

(52) U.S. Cl.
CPC ..... *A41D 15/00* (2013.01); *A41D 27/201* (2013.01); *A41D 3/02* (2013.01); *A41D 2300/322* (2013.01)

(58) Field of Classification Search
CPC ..... A41D 3/02; A41D 27/201
See application file for complete search history.

(56) References Cited

U.S. PATENT DOCUMENTS

| | | | | |
|---|---|---|---|---|
| 2,229,216 | A * | 1/1941 | Marinsky | A44B 19/26 24/382 |
| 3,448,463 | A * | 6/1969 | Milone | A41D 1/06 2/234 |
| 8,234,720 | B2 * | 8/2012 | Freedman | A41D 27/201 2/108 |
| 9,066,547 | B2 | 6/2015 | Kim | |
| 9,474,311 | B2 | 10/2016 | Short | |
| 2009/0265829 | A1 * | 10/2009 | Gomes Seguin | A41D 3/04 2/87 |
| 2010/0115684 | A1 * | 5/2010 | Freedman | A41D 1/04 2/128 |
| 2010/0127025 | A1 * | 5/2010 | Kelling | A41D 15/04 224/153 |
| 2012/0030864 | A1 | 2/2012 | Marois et al. | |
| 2017/0055612 | A1 | 3/2017 | Francis, II | |

FOREIGN PATENT DOCUMENTS

| | | |
|---|---|---|
| CN | 202635624 | 1/2013 |
| DE | 202015004885 | 9/2015 |
| WO | 2013067755 | 5/2013 |

* cited by examiner

*Primary Examiner* — Clinton T Ostrup
*Assistant Examiner* — Andrew Wayne Sutton
(74) *Attorney, Agent, or Firm* — Brient IP Law, LLC

(57) ABSTRACT

A jacket that features separate front pockets when unfastened but when the jacket is fastened the front pockets combine to form a single continuous pass-through front pocket. A double zipper mechanism is used to close the jacket and simultaneously join the two front pockets. A pair of internal zippers are used to open each pocket individually allowing full through access across the combined pocket.

17 Claims, 8 Drawing Sheets

MULTIFUNCTION ZIPPER CONFIGURATION FOR JACKET

CROSS REFERENCE TO RELATED APPLICATION

This application is a continuation of U.S. patent application Ser. No. 15/902,319, filed Feb. 22, 2018, entitled "Multifunction Zipper Configuration For Jacket," which claims priority to U.S. Provisional Application No. 62/578,186, filed Oct. 27, 2017, which is hereby incorporated herein by reference in its entirety.

BACKGROUND

A jacket is put on or removed through the standard method of a person inserting their arms individually into each sleeve of the jacket and then choosing to either leave the front of the jacket open or fasten the jacket. The most common reason for closing a jacket is to provide added warmth or a sense of security. Under both scenarios, it would be advantageous and desirable for the individual to have the ability to insert their hands deeper into a pocket and clasp their hands together. The operation of such a jacket should never cause an atypical additional opening in any of the pockets where an item could fall out of any of the pockets or cold air can enter the jacket.

There is a need for a jacket that closely resembles a normal garment available in the market but allows for the front pockets of a standard jacket to form a pass through pocket when the jacket is closed. This functionality allows the separate front pockets to convert into a single continuous pass-through front pocket without creating an opening where an item could fall out of the pockets.

SUMMARY

The various embodiments discussed herein provide an outer garment that has the convenience of a standard jacket that can be worn or removed using a front opening and the benefit of a single pocket that with an opening on both the right and left sides typically found on a pull-over sweatshirt. The various embodiments can be applied to many styles of jacket and is most directly associated with a casual or sport type of outer garment that has a hood for covering the head of the wearer.

The embodiments described herein provide a jacket with at least a back panel and two front panels that can connect to form a single front panel of the jacket. For the purposes of this disclosure, the term "panel" may include a separate piece or pieces of material, or a portion of a continuous piece of material. Specifically, a "front panel" is a portion of the jacket visible from the front. Two front panels may be selectively coupled and uncoupled to close and open the front of the jacket. Each front panel may include a separate piece or pieces of material that are sewn or otherwise attached to a back piece or pieces of material to create the jacket, or the jacket may be made from a single piece of material such that the front panels and the back portion of the jacket are continuous without any seams. For clarity purposes when describing the structure of the jacket, the two portions that are visible from the front and that may be selectively coupled and uncoupled are referred to as "front panels."

Attached to both front panels are pockets, each with a permanent opening on the same respective side of each front panel that constitutes the pocket opening for each of the individual pockets. The two front panels are joined to close the front of the jacket using a zipper that is attached to the entire length of the jacket opening. This zipper is referred to as the back zipper. The two front pockets are connected by a second zipper that also travels the entire length of the jacket opening, this zipper is referred to as the front zipper. The front and back zipper are coupled together along their entire length only separating where the front zipper connects to the front pockets and the back zipper remains connected to the front jacket panels. Both front and back zippers utilize a single integrated slide capable of connecting two zipper coils, one being the front zipper and one being the back zipper, that operate both zipper coils simultaneously. Pulling the slide up closes the jacket and connects the front pockets while pulling the slide down opens the jacket and disconnects the front pockets. Both front pockets have a pocket zipper at the innermost edge of the pocket opposite the pocket opening. These zippers are referred to as the right and left pocket zippers. These pocket zippers are operated individually to open their respective pockets for the purpose of accessing the adjacent pocket. When both pocket zippers are in the unzipped position, the two individual pockets form a single continuous pass-through front pocket.

DETAILED DESCRIPTION OF VARIOUS EMBODIMENTS

Jacket Structure

Figure 1:
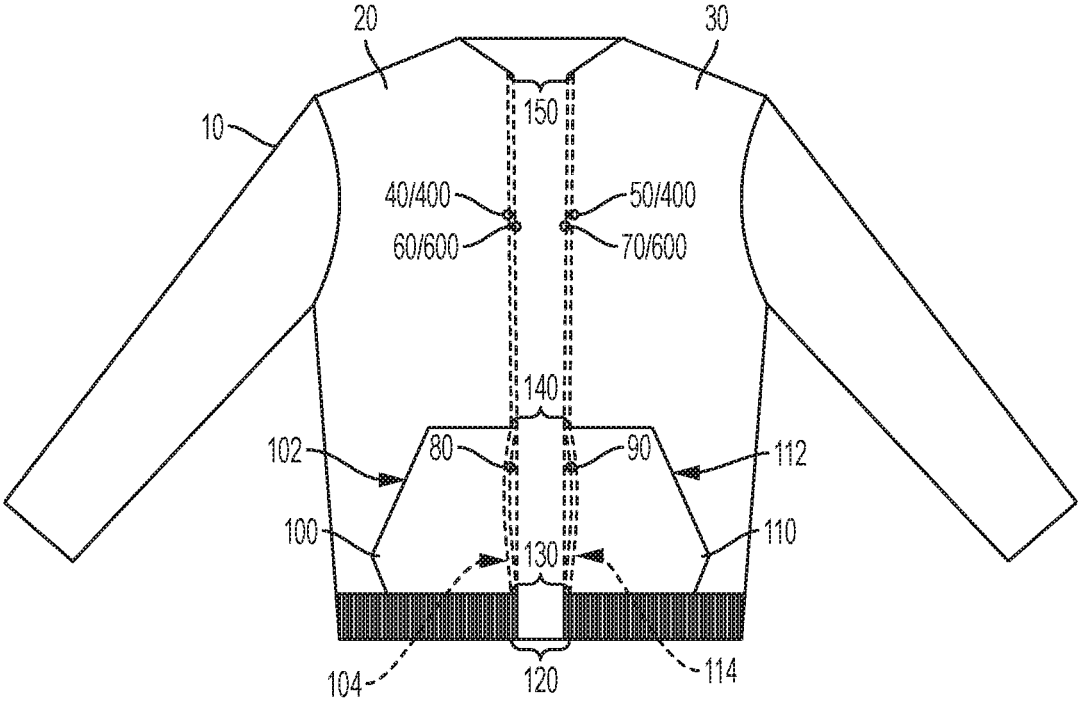
FIG. 1 is a front view of a jacket employing an improved zipper configuration according to various embodiments described herein.
Figure 2:
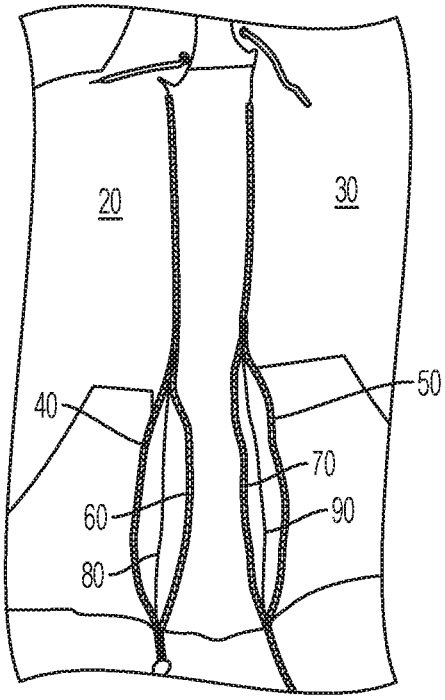
FIG. 2 is a close-up view of the jacket of FIG. 1 with the zipper unfastened according to various embodiments described herein.

Referring to FIGS. 1 and 2, a jacket 10 is intended to be worn as an outer garment. The front of the jacket 10 is comprised of the two fabric panels, a right front panel 20 and a left front panel 30. The right front panel 20 and the left front panel 30 are selectively closable by engaging a zipper mechanism that includes a pair of zippers and a single zipper slide. The zippers are shown as zipper tapes 40 and 50 that define a front zipper 400, and as zipper tapes 60 and 70 that define a back zipper 600. The front zipper 400 is configured to engage and disengage zipper tapes 40 and 50 to couple and uncouple the right front panel 20 and the left front panel 30 to close and open the jacket 10. The back zipper 600 is similarly configured to engage and disengage zipper tapes 60 and 70 to couple and uncouple the right front panel 20 and the left front panel 30 to close and open the jacket 10. The front zipper 400 and the back zipper 600 are configured to be operated together using a single zipper slide that simultaneously engages the front and back zippers. In this manner, the front zipper 400 and the back zipper 600 are both open-ended zippers that allow full separation and that are configured to close the front of the jacket 10. The single zipper slide will be described in greater detail below.

The jacket 10 includes a right pocket 100 having a right pocket opening 102 to allow a user to reach into the right pocket 100. The right pocket 100 has a right pocket bottom end 104 that is selectively closable via a right pocket zipper 80. According to one embodiment, the right pocket zipper 80 is a two-way closed-end zipper with a single slide. The jacket 10 also includes a left pocket 110 having a left pocket opening 112 and a left pocket bottom end 114, with corresponding left pocket zipper 90. Similar to the structure and functionality of the right pocket zipper 80, the left pocket zipper 90 may be a two-way closed-end zipper with a single slide that is selectively closeable to open and close the left pocket bottom end 114. When the right and left pocket zippers 80 and 90 are unzipped, access is provided between the front and back zippers 400 and 600 to transform the individual right and left pockets 100 and 110 into a single continuous pass-through front pocket 200, demonstrated most clearly in FIG. 6. It should be appreciated that while the right pocket zipper 80 and the left pocket zipper 90 are described herein as being zippers, the right pocket zipper 80 and the left pocket zipper 90 may alternatively be any type of fastening mechanisms capable of selectively opening and closing the right and left pocket bottom ends 104 and 114, respectively. For example, the right and left pocket bottom ends 104 and 114 may be opened and closed using hook and loop fasteners to provide access between the zipper tapes.

Figure 5:
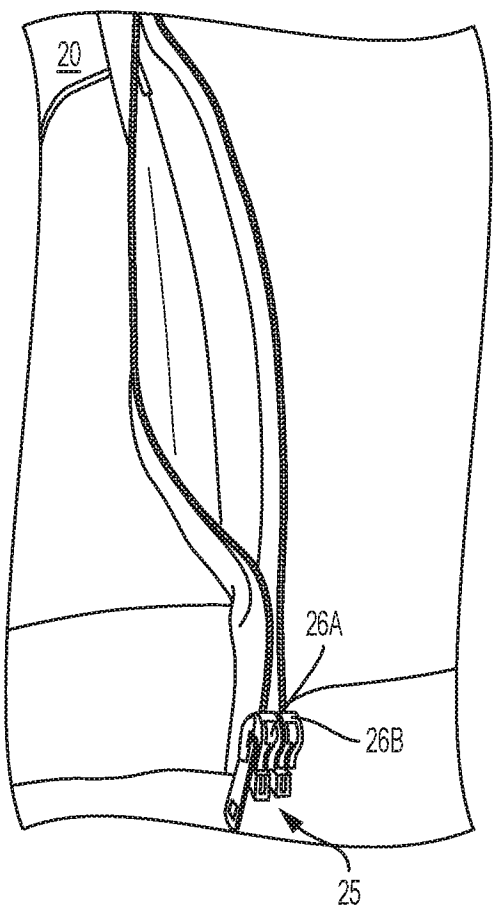
FIG. 5 is a close-up view of the open right-hand side of the jacket of FIG. 3 according to various embodiments described herein.
Figure 4:
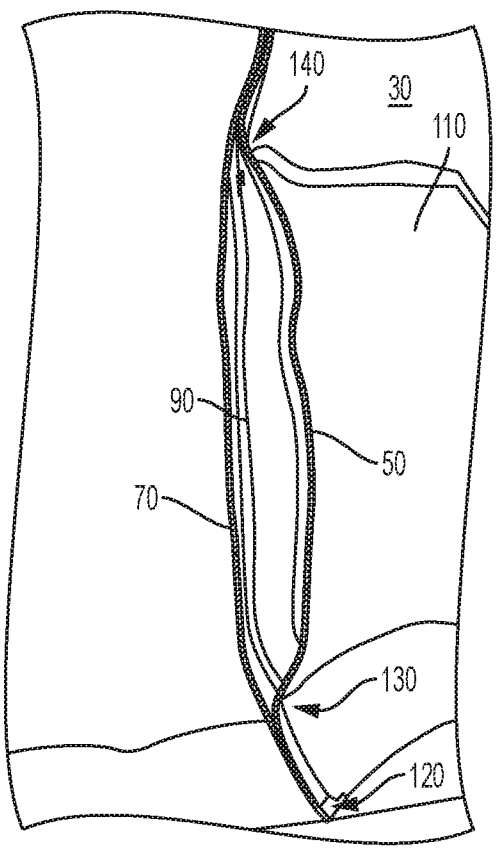
FIG. 4 is a close-up view of the left-hand side of the jacket of FIG. 1 according to various embodiments described herein.
Figure 3:
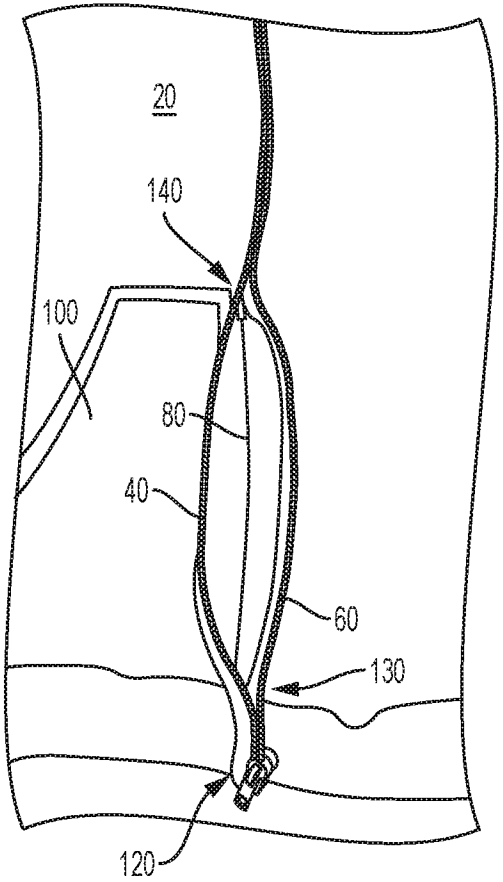
FIG. 3 is a close-up view of the right-hand side of the jacket of FIG. 1 according to various embodiments described herein.
Figure 8:
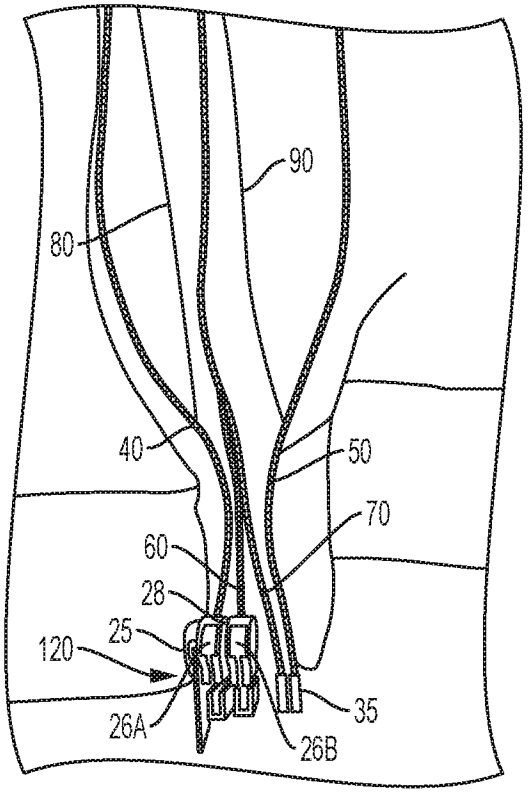
FIG. 8 is a close-up view of the single integrated pocket slide and the dual coiled zippers used in the jacket of FIG. 1 according to various embodiments described herein.

As discussed above, according to various embodiments, the front and back zippers 400 and 600 are operated simultaneously using a single zipper slide. The single zipper slide 25 is best shown in FIGS. 5 and 8. In various embodiments, the single zipper slide 25 may be a single integrated zipper slide that is configured to engage two separate pairs of zipper tapes, a first zipper tape pair in the front (e.g., the zipper tapes 40 and 50) and a second zipper tape pair behind the first zipper tape pair (e.g., the zipper tapes 60 and 70). To do so, the single zipper slide 25 has a first coil channel 26A defining a first zipper slide configured to engage the zipper teeth or coils on zipper tapes 40 and 50, and a second coil channel 26B defining a second zipper slide configured to engage the zipper teeth or coils on zipper tapes 60 and 70. According to one embodiment, the first and second coil channels 26A and 26B are integrated together so that they are fixed in place and are not separable. In alternative embodiments, the zipper slide 25 may be formed by connecting two separate zipper slides together such that they are aligned and move in unison with one another. In these alternative embodiments, the first and second coil channels 26A and 26B may be independent from one another in that they are not connected, or may be connected via a connection mechanism 28. The connection mechanism 28 may include adhesive, hook and loop fasteners, snaps, or any suitable means for securing the front zipper slide to the back zipper slide. In alternative embodiments, the zipper slide 25 may be a zipper slide with a single channel that is sufficiently large and configured to engage two separate pairs of zipper tapes, a first zipper tape pair in the front (e.g., the zipper tapes 40 and 50) and a second zipper tape pair behind the first zipper tape pair (e.g., the zipper tapes 60 and 70).

Referring to FIGS. 3-6, the zipper tapes 40 and 60 are both attached to the right front panel 20 while and zipper tapes 50 and 70 are both attached to the left front panel 30 from position 120 to position 130 and again at position 140 to position 150. On the right-hand side of the jacket 10, between position 130 and position 140, the zipper tape 40 is attached to the right pocket 100 while the zipper tape 60 is attached to the right front panel 20. On the left-hand side of the jacket 10 between positions 130 and 140, the zipper tape 50 is attached to the right pocket 100 while the zipper tape 70 is attached to the left front panel 30. In various embodiments, position 120 and 130 may be in the same location.

Figure 6:
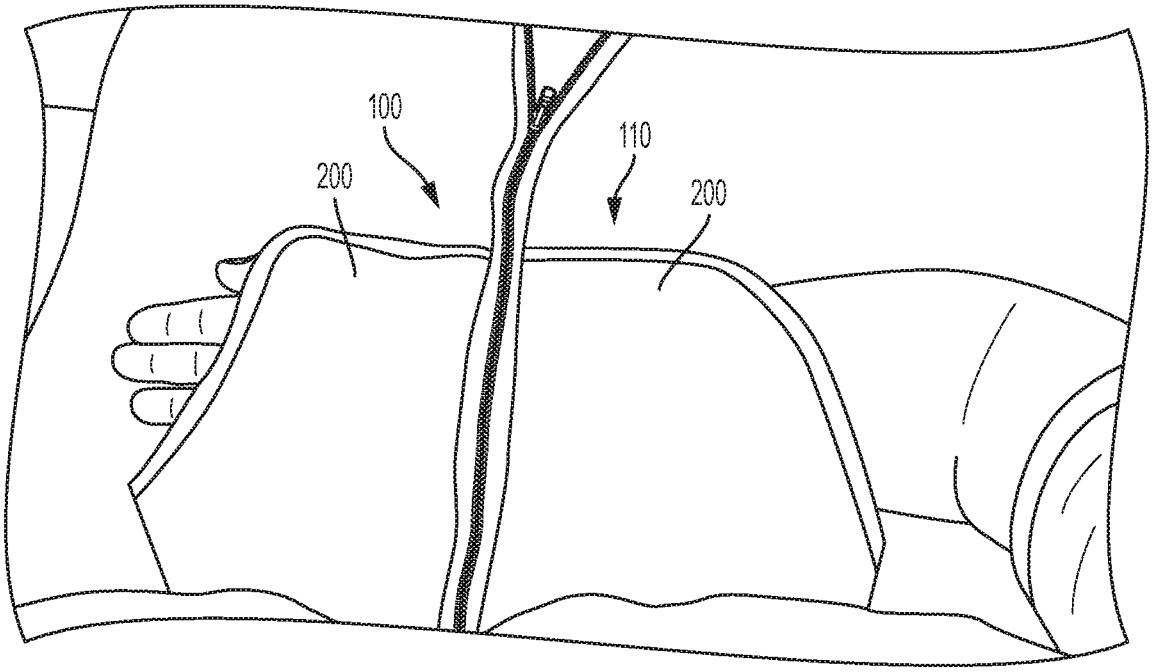
FIG. 6 is a close-up view of a fastened jacket of FIG. 1 showing the connected single pocket according to various embodiments described herein.

The right pocket zipper 80 is attached to both the right front panel 20 and the right pocket 100 from position 130 to position 140, with the zipper pull facing the inside of the pocket. In this manner, the right pocket 100 has a right pocket opening 102, and a second opening that is positioned at the right pocket bottom end 104 adjacent zipper tapes 40 and 60, between positions 130 and 140, that is selectively closable using right pocket zipper 80. In a similar configuration, zipper 90 is attached to both the left front panel 30 and the left pocket 110 from position 130 to position 140, with the zipper pull facing the inside of the pocket. In this manner, the left pocket 110 has a left pocket opening 112, and a second opening that is positioned adjacent zipper tapes 50 and 70, between positions 130 and 140, that is selectively closable using zipper 90. Referring to FIG. 6, the jacket is shown with the right and left pocket zippers 80 and 90 (not shown in FIG. 6) opened so that individual pockets 100 and 110 form a single pass-through pocket 200.

It should be understood that the jacket may be formed from any suitable material such as fabric made from cotton, flax, wool, denim, leather, nylon, polyesters, etc. Additionally, the jacket design may include sleeves, may be sleeveless such as a vest, or may include short sleeves. The jacket may also include a hood. In various embodiments, the jacket may also include filler such as down, feathers, or any other suitable filler based on the use of the jacket.

Operation of the Jacket

Figure 7:
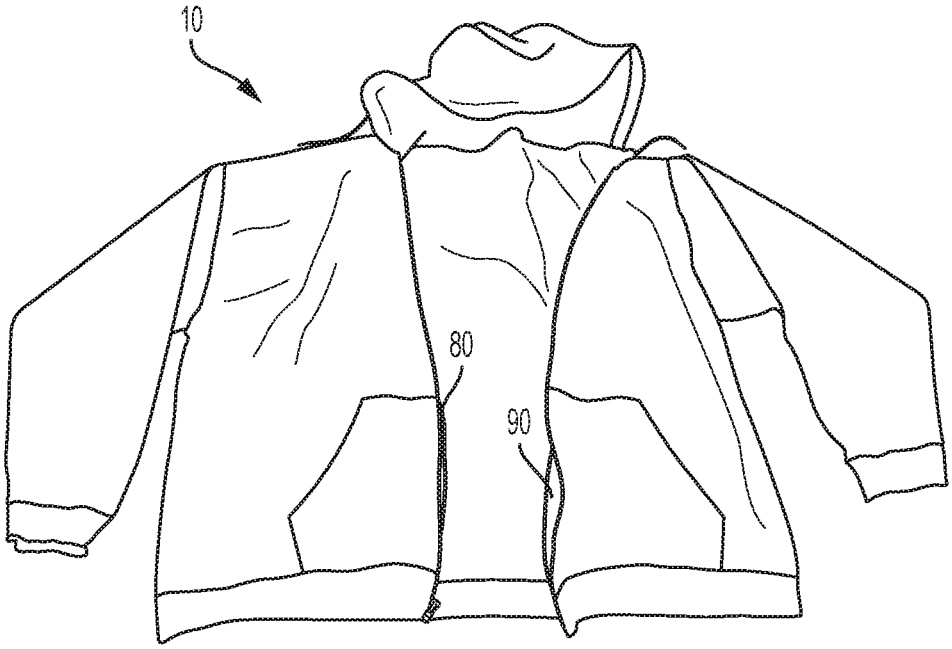
FIG. 7 illustrates a front view of the Jacket of FIG. 1 unzipped according to various embodiments described herein.
Figure 9:
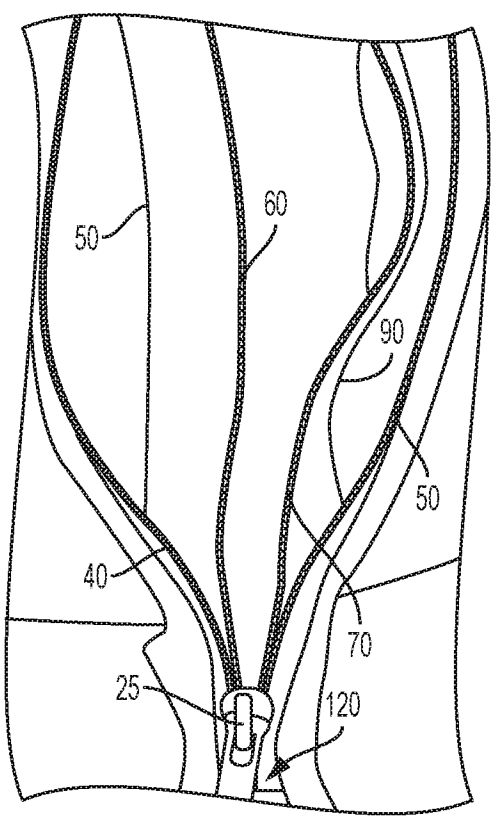
FIG. 9 is a close-up view of the dual coiled zippers engaging to fasten the jacket where the pocket zippers are closed according to various embodiments described herein.
Figure 10:
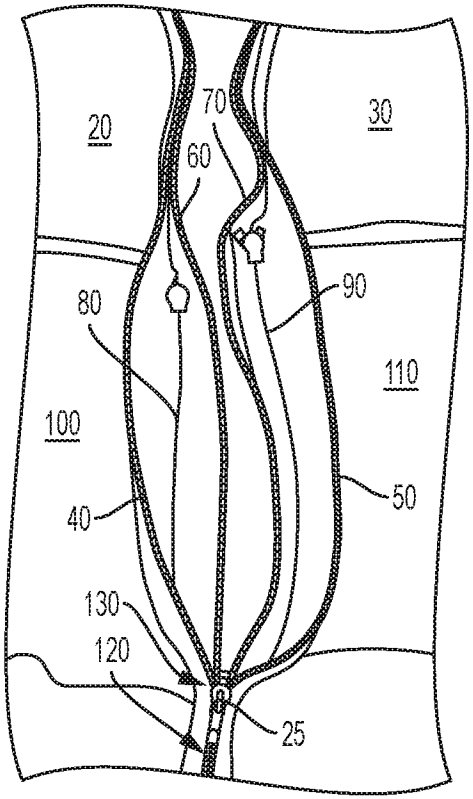
FIG. 10 is a close-up view of the dual coiled zippers engaged to fasten the jacket at the bottom of the front pockets according to various embodiments described herein.

Referring to FIG. 7, the jacket 10 is shown in the open position (e.g., unzipped) with the right and left pocket zippers 80 and 90, respectively, shown in the closed position. Referring to FIG. 8, the single zipper slide 25 is shown positioned at 120 adjacent the dual zipper tapes 50 and 70. The back side (the side of the zipper that does not have a pull tab) of the right and left pocket zippers 80 and 90 are shown selectively closed, maintaining the integrity of each pocket while the jacket is unfastened (e.g., each pocket has an opening on one side and is closed at the other side). Referring to FIG. 9, the single zipper slide 25 is shown engaged with the zipper ends 35 (FIG. 8) to fasten the jacket below the front pockets at 120. Referring now to FIG. 10, the single zipper slide 25 is shown moved from position 120 to position 130 at the bottom of the right and left pockets 100 and 110. When fastening (zipping up) the jacket, it is at this point where the dual zipper tapes separate with the outer tapes 40 and 50 joining the respective pockets 100 and 110 and the inner tapes 60 and 70 joining the respective right front panel 20 and left front panel 30 of the jacket 10. The right and left pocket zippers 80 and 90 are shown closed in this figure.

Figure 12:
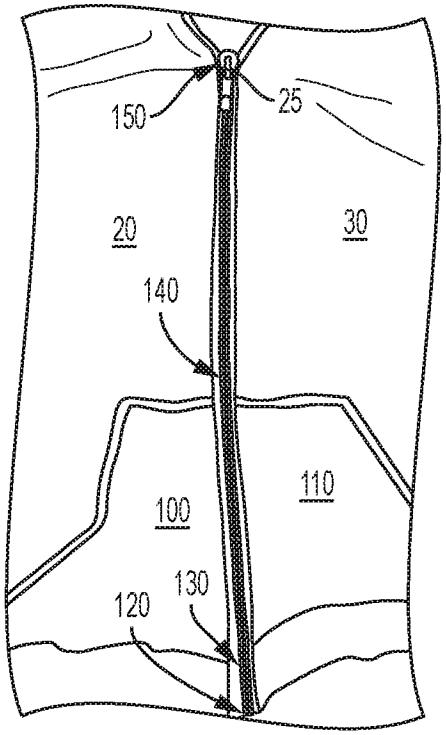
FIG. 12 is a close-up view of the integrated zipper slide engaged to fasten the jacket at the top of both front panels of the jacket according to various embodiments described herein.
Figure 11:
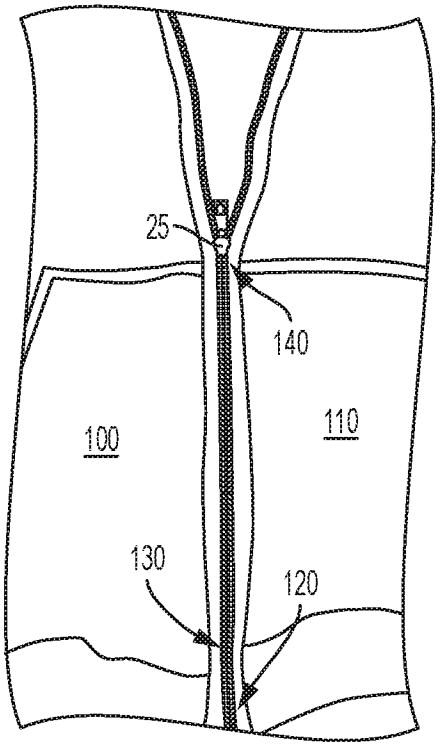
FIG. 11 is a close-up view of the integrated zipper slide engaged to fasten the jacket at the top of the front pockets according to various embodiments described herein.

FIG. 11 shows the single zipper slide 25 engaged to fasten the jacket at the top of the front pockets at position 140. When fastening (zipping up) the jacket, it is at this point 140 that the dual zipper tapes join back together to both join to their respective front panels of the jacket. Once the single zipper slide 25 passes position 140 above the pockets, the wearer can then unfasten (unzip) the right and left pocket zippers 80 and 90 to transform the individual separate front pockets, or right and left pockets 100 and 110, to a single continuous pass-through front pocket 200 that is accessible from both pocket outside openings. Referring to FIG. 12, the single zipper slide 25 is shown fastening the zipper tapes 40 and 50 of the front zipper 400, as well as the zipper tapes 60 and 70 of the back zipper 600, at the top of both right and left front panels 20 and 30 of the jacket at position 150, thereby fully fastening the jacket 10.

Figure 15:
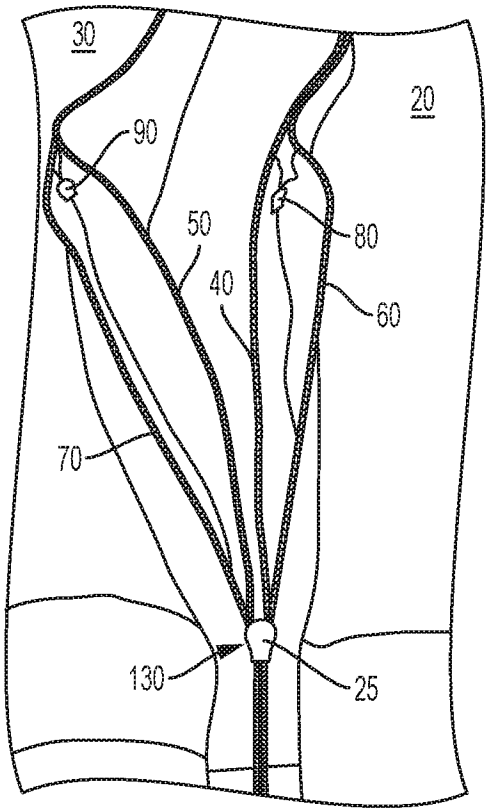
FIG. 15 is close-up view of the jacket inside out to show the zipper slide engaged to fasten the jacket at the bottom of the front pockets according to various embodiments described herein.
Figure 14:
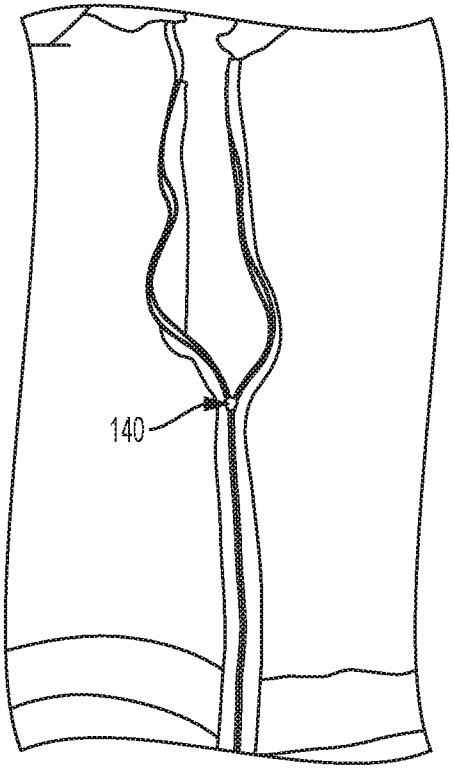
FIG. 14 is a close-up view of the jacket inside out to show the zipper slide engaged to fasten the jacket at the top of the front pockets according to various embodiments described herein.
Figure 13:
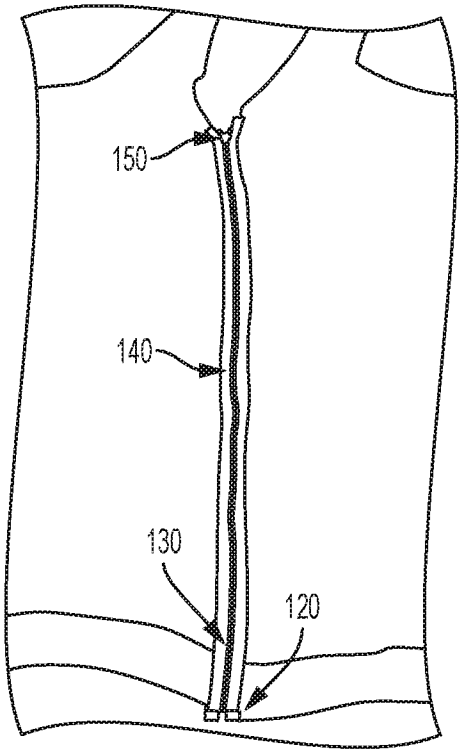
FIG. 13 is a close-up view of the jacket inside out to show the zipper slide engaged to fasten the jacket at the top of both front panels of the jacket according to various embodiments described herein.
Figure 16:
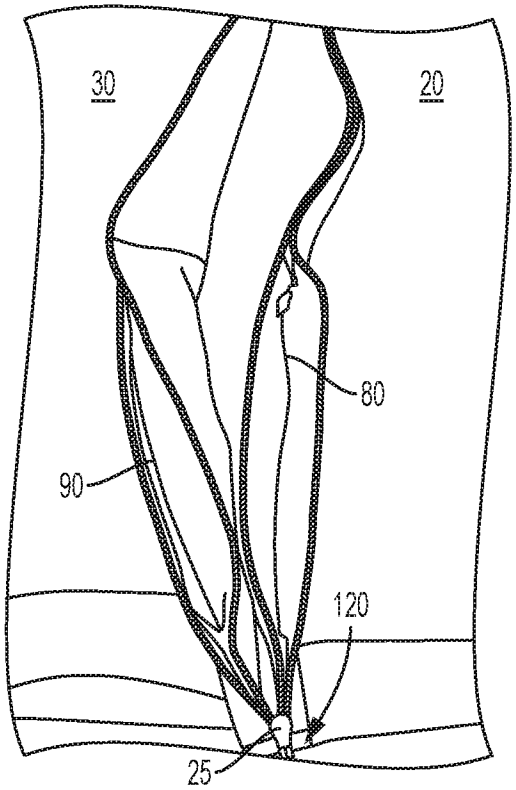
FIG. 16 is close-up view of the jacket inside out to show the zipper slide engaged to fasten the jacket at the bottom of both front panels according to various embodiments described herein.

FIGS. 13-16 illustrate the jacket inside out where the jacket zipper is fully zipped closed in FIG. 13, unzipped to position 140 in FIG. 14, and unzipped to position 130 in FIG. 15. When unfastening (unzipping) the jacket 10, when the single zipper slide 25 moves from position 140 to position 130, the dual zipper tapes separate to unfasten both the front pockets 100 and 110 and the right and left front panels 20 and 30 of the jacket. Thus, before the slide moves past position 140, the wearer would fasten (zip up) the right and left pocket zippers 80 and 90 to close the inner openings and transform the single continuous pass-through front pocket 200 back to the two separate individual pockets. Finally, FIG. 16 shows the jacket inside out to show the integrated zipper slide engaged to fasten the jacket at the bottom of both front panels at position 120. When unfastening (unzipping) the jacket, it is at just after this point that the dual zipper is completely unfastened so that the jacket can be removed. The pocket zippers 80 and 90 are shown closed in this figure.

Alternative Embodiments of a Jacket

Figure 17:
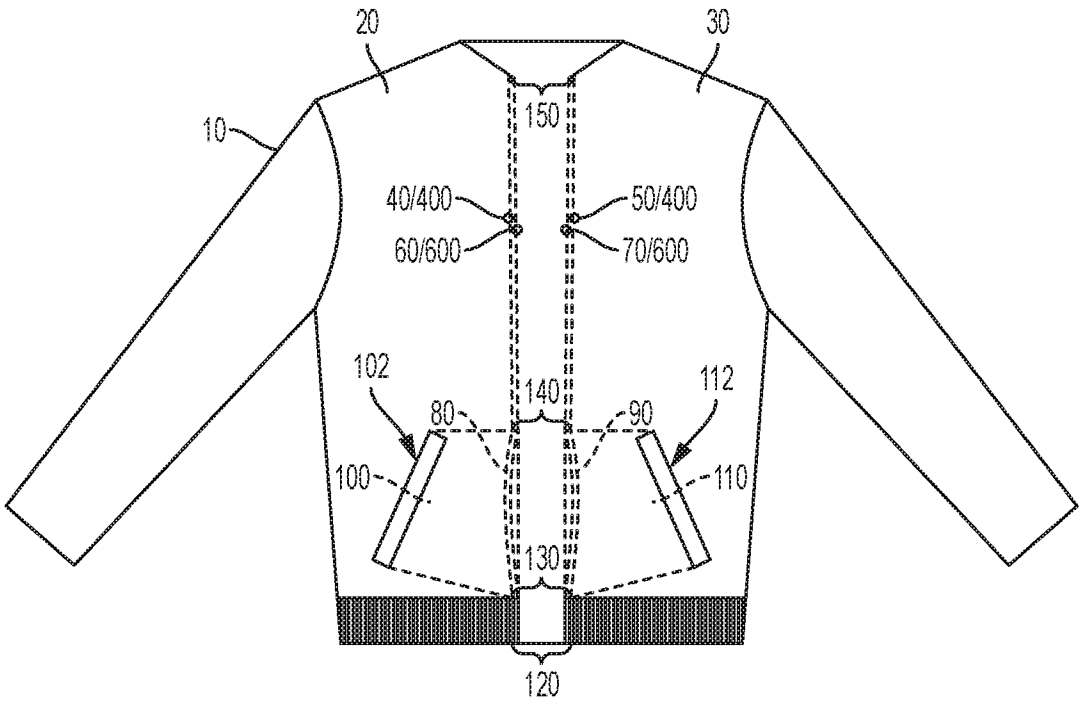
FIG. 17 is a front view of the jacket employing a zipper configuration of a jacket according to alternative embodiments described herein.

FIG. 17 illustrates an alternative configuration of a jacket 10. As described with respect to previous embodiments, the jacket 10 has a back panel and the right and left front panels 20 and 30 that can connect to form a single front panel of the jacket 10. However, with this embodiment, the right pocket 100 and the left pocket 110 are inside the right front panel 20 and the left front panel 30, respectively, rather than being externally attached to the front panels.

In other words, the right and left front panels 20 and 30 provide the front walls to the right and left pockets 100 and 110, respectively. In contrast, in previous embodiments described above, the right and left front panels 20 and 30 provide the back walls to the right and left pockets 100 and 110, respectively.

In this alternative embodiment in which the right pocket 100 and the left pocket 110 are attached to the interior of the front panels 20 and 30 of the jacket 10, the right pocket opening 102 and the left pocket opening 112 are each formed within the front panels 20 and 30 so that the user reaches through the front panels 20 and 30 and into the pockets. The right and left front panels 20 and 30 are joined to close the front of the jacket 10 using a zipper that is attached to the entire length of the jacket opening. This zipper is referred to as the front zipper 400 and is formed from a first zipper tape 40 and a second zipper tape 50. The two front pockets are connected by a second zipper consisting of a first zipper tape 60 and a second zipper tape 70 that also travels the entire length of the jacket opening. This second zipper is referred to as the back zipper 600. The front and back zippers 400 and 600 are coupled together along their entire length only separating where the front zipper 400 connects to the front jacket panels and the back zipper 600 remains connected to the pockets between positions 130 and 140.

Both front and back zippers 400 and 600 utilize a single zipper slide 25 with two coil channels 25A and 25B that operate both zipper coils simultaneously. Pulling the slide up closes the jacket 10 and connects the front pockets while pulling the slide down opens the jacket 10 and disconnects the front pockets. The right pocket 100 and the left pocket 110 have a right pocket zipper 80 and a left pocket zipper 90, respectively, at the innermost edge of the pockets (i.e., adjacent the front zipper) opposite from the pocket openings 102 and 112. These zippers are operated individually to open their respective pockets for the purpose of accessing the adjacent pocket. When both zippers are in the unzipped position, the two individual pockets form a single continuous pass-through front pocket 200 that engages at the bottom of the pockets and terminates at the top of the pockets, completing the joining operation to form the single continuous pass-through front pocket 200.

The front and back zippers 400 and 600, respectively, are open-ended zippers that allow full separation. The zippers shown as right and left pocket zippers 80 and 90 are two-way closed-end zippers with a single slide. The right and left front panels 20 and 30 are joined to close the jacket 10 by engaging the zipper tapes 40 and 50 while simultaneously joining the zipper tapes 60 and 70 using a single zipper slide 25 that engages both zipper tape pairs. The zipper tape 40 is attached to the right front panel 20 from position 120 to position 150. The zipper tape 60 is attached to the right front panel 20 from position 120 to position 130 and again from position 140 to 150. The zipper tape 60 is attached to the right inner pocket 100 from position 130 to position 140. The zipper tape 50 is attached to the left front panel 30 from position 120 to position 150. The zipper tape 70 is attached to the left front panel 30 from position 120 to position 130 and again from position 140 to 150. The zipper tape 70 is attached to the left pocket 110 from position 130 to position 140. The right pocket zipper 80 is attached to both the right front panel 20 and the right pocket 100 from position 130 to position 140, with the zipper pull facing the inside of the pocket 100. The left pocket zipper 90 is attached to both the left front panel 30 and the left pocket 110 from position 130 to position 140, with the zipper pull facing the inside of the pocket 110. The front and back zippers 400 and 600, as well as the right and left pocket zippers 80 and 90, function in a similar manner as described above with respect to the embodiments of FIGS. 1-16.

Figure 18:
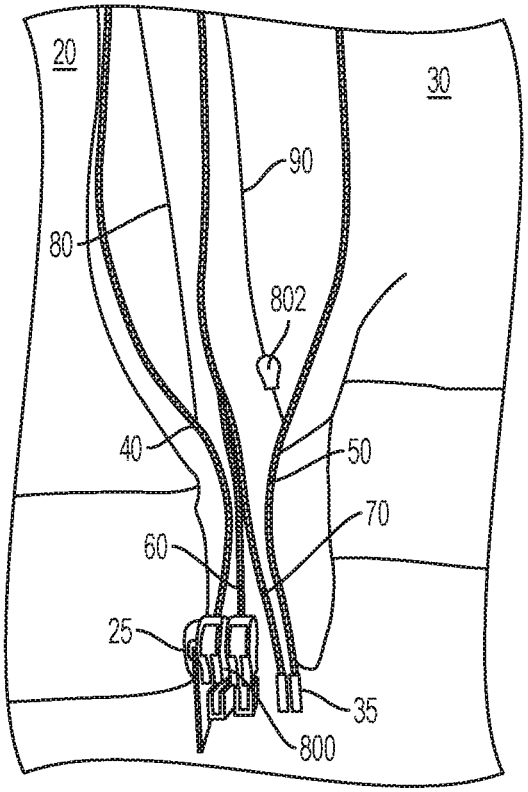
FIG. 18 is a close-up view of the single integrated pocket slide and the pocket zippers utilizing engagement mechanisms according to various embodiments described herein.

FIG. 18 illustrates yet another alternative embodiment of the jacket 10. According to this embodiment, when the user pulls upward on the single zipper slide 25 to close the right front panel 20 and the left front panel 30 together, the single zipper slide 25 engages the right and left pocket zippers 80 and 90 and pulls the pocket zippers upward to open the right and left pockets 100 and 110 and create the single continuous pass-through front pocket 200. Similarly, as the single zipper slide 25 is lowered to unzip the jacket 10, the single zipper slide 25 engages the right and left pocket zippers 80 and 90 and pulls the pocket zippers downward to close the single continuous pass-through front pocket 200 and create the separate right and left pockets 100 and 110. In this embodiment, the right and left pocket zippers 80 and 90 pull upward to open the zippers and provide access through the front and back zippers 400 and 600 to create the single continuous pass-through front pocket 200, and pull downward to close the zippers and create the right and left pockets 100.

By coordinating the opening and closing of the right and left pocket zippers 80 and 90 with the closing and opening of the front and back zippers 400 and 600, the user can enjoy and continuous pass-through front pocket 200 whenever the jacket 10 is zipped up, while having separate right and left pockets 100 whenever the jacket 10 is unzipped. To provide this functionality, the single zipper slide 25 may have a slide engagement mechanism 800 that connects to corresponding pocket zipper engagement mechanisms 802 on each of the right and left pocket zippers 80 and 90. The slide engagement mechanism 800 and the corresponding pocket zipper engagement mechanisms 802 may include any suitable device or means for engaging the single zipper slide 25 with the right and left pocket zippers 80 and 90 upon initial contact during zipping or unzipping operations and disengaging upon reaching position 140 while zipping or position 130 while unzipping the single zipper slide.

As an example, the slide engagement mechanism 800 may include a tab, while the pocket zipper engagement mechanisms 802 include a structural feature that is contacted by the tab and allows the single zipper slide 25 to pull the pocket zippers upward or downward to their full open or closed positions. Upon reaching the full open or closed positions (e.g., position 140 and position 130), a zipper stop engaged by the right and left pocket zippers 80 and 90 may mechanically retract the tab and/or the structural feature of the right and left pocket zippers 80 and 90 engaged by the tab in order to allow the single zipper slide 25 to disengage the pocket zippers and continue beyond the boundaries of the right and left pockets 100 and 110.

According to another example implementation, the slide engagement mechanism 800 and the pocket zipper engagement mechanisms 802 may include magnets. When the single zipper slide 25 moves adjacent to the right and left pocket zippers 80 and 90, the corresponding magnets engage one another. The strength of the magnets allows the right and left pocket zippers 80 and 90 to be pulled with the movement of the single zipper slide 25 until zipper stops are encountered by the right and left pocket zippers 80 and 90. The zipper stops prevent further movement of the right and left pocket zippers 80 and 90. Continued movement of the single zipper slide 25 disengages the magnets and allows for the single zipper slide 25 to continue beyond the boundaries of the right and left pockets 100 and 110.

CONCLUSION

While this specification contains many specific embodiment details, these should not be construed as limitations on the scope of any disclosure or of what may be claimed, but rather as descriptions of features that may be specific to particular embodiments of particular disclosures. Certain features that are described in this specification in the context of separate embodiments may also be implemented in combination in a single embodiment. Conversely, various features that are described in the context of a single embodiment may also be implemented in multiple embodiments separately or in any suitable sub-combination. Moreover, although features may be described above as acting in certain combinations and even initially claimed as such, one or more features from a claimed combination may in some cases be excised from the combination, and the claimed combination may be directed to a sub-combination or variation of a sub-combination.

Many modifications and other embodiments of the disclosure will come to mind to one skilled in the art to which this disclosure pertains having the benefit of the teachings presented in the foregoing descriptions and the associated drawings. For example, it should be appreciated that alternative embodiments may provide for a front or back zipper engaging zipper tape that is attached to the right and left pockets may extend only to the top edge, or proximate the top edge, of the pockets rather than extending the entire length of the front panels of the jacket. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for the purposes of limitation.

What is claimed:

1. A garment comprising:

a first panel;

a second panel;

a first pocket having a first side and an opposite second side;

a second pocket having a first side and an opposite second side;

a first zipper comprising:

a first zipper tape;

a second zipper tape; and a first zipper slide for opening and closing the first zipper;

a second zipper comprising:

a third zipper tape;

a fourth zipper tape; and a second zipper slide for opening and closing the second zipper;

a first closed-end two way zipper positioned intermediate the first pocket opposite second end and the first panel; and a second closed-end two way zipper positioned intermediate the second pocket opposite second end and the second panel, wherein, the first zipper tape is coupled to the first panel, the second zipper tape is coupled to the second panel, the third zipper tape is coupled to the first panel except where it is coupled to the first pocket, and the fourth zipper tape is coupled to the second panel except where it is coupled to the second pocket, and wherein, the first zipper slide releasably couples the first zipper tape to the second zipper tape when the first zipper slide is moved with respect to the first zipper tape and the second zipper tape, and the second zipper slide releasably couples the third zipper tape to the fourth zipper tape when the second zipper slide is moved with respect to the third zipper tape and the fourth zipper tape.

2. The garment of claim 1, wherein the first zipper slide and the second zipper slide are coupled to one another so that the first and second zipper slides move together.

3. The garment of claim 1, wherein the first zipper slide and the second zipper slide are integrally formed as a single zipper slide.

4. The garment of claim 1, wherein when the first zipper slide and the second zipper slide are moved so that the first zipper tape engages with the second zipper tape, and the third zipper tape engages with the fourth zipper tape so that the first panel is releasably secured to the second panel, and when the first closed-end two way zipper and the second closed-end two way zipper are moved into an opened position, the first pocket and the second pocket open into one another at the second opposite side of each respective pocket to form a single pass-through pocket.

5. A garment, comprising:

a back panel, a right front panel, and a left front panel secured together to create a jacket;

a front zipper extending along an entire length of the right front panel and the left front panel;

a back zipper extending along the entire length of the right front panel and the left front panel;

a right pocket attached to the right front panel and having a right pocket opening and a right pocket bottom end, wherein the right pocket bottom end is positioned proximate to the front zipper and the back zipper and comprises a right pocket zipper; and a left pocket attached to the left front panel and having a left pocket opening and a left pocket bottom end, wherein the left pocket bottom end is positioned proximate to the front zipper and the back zipper and comprises a left pocket zipper, wherein the right pocket zipper and the left pocket zipper are each configured to open to create a single continuous pass-through front pocket extending between the front zipper and the back zipper, and to close to create two separate front pockets in the jacket.

6. The garment of claim 5, wherein the front zipper and the back zipper are uncoupled along a length of the right front panel and the left front panel defined by the right pocket and the left pocket, and coupled together along a length from the right pocket and the left pocket to a top of the right front panel and the left front panel.

7. The garment of claim 5, further comprising a single zipper slide configured to simultaneously engage the front zipper and the back zipper.

8. The garment of claim 5, further comprising:

a front zipper slide configured to engage the front zipper; and a back zipper slide configured to engage the back zipper, wherein the front zipper slide and the back zipper slide are aligned and connected such that the front zipper slide and the back zipper slide move in unison.

9. The garment of claim 5, wherein the right pocket is sewn to an outside surface of the right front panel, and wherein the left pocket is sewn to an outside surface of the left front panel such that the right pocket and the left pocket are each on the outside of the jacket.

10. The garment of claim 5, wherein the right pocket is sewn to an inside surface of the right front panel, and wherein the left pocket is sewn to an inside surface of the left front panel such that the right pocket and the left pocket are each on the inside of the jacket.

11. A jacket comprising:

a back panel;

a right front panel;

a left front panel;

a front zipper;

a back zipper;

a single zipper slide configured to simultaneously engage the front zipper and the back zipper; and two pockets, each pocket having a pocket opening, a bottom end, and a pocket zipper positioned proximate to the bottom end, the pocket zipper configured to provide access through the pocket and between the front zipper and the back zipper, wherein the back panel, the right front panel, and the left front panel are secured together with the front and back zippers secured to the right front panel and the left front panel, and wherein the front zipper and the back zipper extend along an entire length of the right front panel and the left front panel.

12. The jacket of claim 11, wherein the two pockets comprise a right pocket and a left pocket, and wherein the front zipper and the back zipper are uncoupled along a length of the right front panel and the left front panel defined by the right pocket and the left pocket, and coupled together along a length from the right pocket and the left pocket to a top of the right front panel and the left front panel.

13. A jacket comprising:

a front zipper;

a back zipper;

a single zipper slide configured to simultaneously engage the front zipper and the back zipper; and two pockets, each pocket having a pocket opening, a bottom end, and a pocket zipper positioned proximate to the bottom end, the pocket zipper configured to provide access through the pocket and between the front zipper and the back zipper, wherein the single zipper slide comprises a first zipper slide and the second zipper slide integrally formed as a single zipper slide with two coil channels.

14. A jacket comprising:

a front zipper;

a back zipper;

a single zipper slide configured to simultaneously engage the front zipper and the back zipper; and two pockets, each pocket having
a pocket opening,
a bottom end, and
a pocket zipper positioned proximate to the bottom end, the pocket zipper configured to provide access through the pocket and between the front zipper and the back zipper,
wherein the two pockets comprise a right pocket and a left pocket,
wherein the right pocket is sewn to an outside surface of the right front panel, and
wherein the left pocket is sewn to an outside surface of the left front panel such that the right pocket and the left pocket are each on the outside of the jacket.

15. A jacket comprising:
a front zipper;
a back zipper;
a single zipper slide configured to simultaneously engage the front zipper and the back zipper; and
two pockets, each pocket having
a pocket opening,
a bottom end, and
a pocket zipper positioned proximate to the bottom end, the pocket zipper configured to provide access through the pocket and between the front zipper and the back zipper,
wherein each pocket zipper comprises a pocket zipper engagement mechanism, and
wherein the single zipper slide comprises a slide engagement mechanism configured to engage each pocket zipper engagement mechanism along a length of a right front panel and a left front panel defined by the two pockets such that movement of the single zipper slide to zip the jacket engages each pocket zipper to open the two pockets and movement of the single zipper slide to unzip the jacket engages each pocket zipper to close the two pockets.

16. A garment comprising:
a first panel;
a second panel;
a first pocket having a first side and an opposite second side;
a second pocket having a first side and an opposite second side;
a first zipper comprising:
a first zipper tape;
a second zipper tape; and
a first zipper slide for opening and closing the first zipper; and
a second zipper comprising:
a third zipper tape;
a fourth zipper tape; and
a second zipper slide for opening and closing the second zipper,
wherein,
the first zipper tape is coupled to the first panel,
the second zipper tape is coupled to the second panel,
the third zipper tape is coupled to the first panel except where it is coupled to the first pocket, and
the fourth zipper tape is coupled to the second panel except where it is coupled to the second pocket, and
wherein,
the first zipper slide releasably couples the first zipper tape to the second zipper tape when the first zipper slide is moved with respect to the first zipper tape and the second zipper tape,
the second zipper slide releasably couples the third zipper tape to the fourth zipper tape when the second zipper slide is moved with respect to the third zipper tape and the fourth zipper tape, and
the first zipper slide and the second zipper slide are coupled to one another so that the first and second zipper slides move together.

17. A garment comprising:
a first panel;
a second panel;
a first pocket having a first side and an opposite second side;
a second pocket having a first side and an opposite second side;
a first zipper comprising:
a first zipper tape;
a second zipper tape; and
a first zipper slide for opening and closing the first zipper; and
a second zipper comprising:
a third zipper tape;
a fourth zipper tape; and
a second zipper slide for opening and closing the second zipper,
wherein,
the first zipper tape is coupled to the first panel,
the second zipper tape is coupled to the second panel,
the third zipper tape is coupled to the first panel except where it is coupled to the first pocket, and
the fourth zipper tape is coupled to the second panel except where it is coupled to the second pocket, and
wherein,
the first zipper slide releasably couples the first zipper tape to the second zipper tape when the first zipper slide is moved with respect to the first zipper tape and the second zipper tape,
the second zipper slide releasably couples the third zipper tape to the fourth zipper tape when the second zipper slide is moved with respect to the third zipper tape and the fourth zipper tape, and
the first zipper slide and the second zipper slide are integrally formed as a single zipper slide.

* * * * *